US005697287A

United States Patent [19]

Fassbender

[11] Patent Number: 5,697,287

[45] Date of Patent: Dec. 16, 1997

[54] HYDRAULIC POWER CYLINDER

[75] Inventor: Rolf Fassbender, Mutlangen, Germany

[73] Assignee: ZF Friedrichshafen AG, Friedrichshafen, Germany

[21] Appl. No.: 737,785

[22] PCT Filed: May 26, 1995

[86] PCT No.: PCT/EP95/02020

§ 371 Date: Nov. 25, 1996

§ 102(e) Date: Nov. 25, 1996

[87] PCT Pub. No.: WO95/33137

PCT Pub. Date: Dec. 7, 1995

[30] Foreign Application Priority Data

Jun. 1, 1994 [DE] Germany ..... 44 19 213.4

[51] Int. Cl.[6] ..... F15B 21/04

[52] U.S. Cl. ..... 92/79; 92/163

[58] Field of Search ..... 92/79, 163

[56] References Cited

U.S. PATENT DOCUMENTS

| | | | |
|---|---|---|---|
| 2,937,502 | 5/1960 | Kenyon | 92/79 |
| 5,390,586 | 2/1995 | Jones | 92/79 |

FOREIGN PATENT DOCUMENTS

| | | | |
|---|---|---|---|
| 0544086 | 6/1993 | European Pat. Off. . | |
| 2406565 | 8/1975 | Germany | 92/79 |
| 3635020 | 4/1987 | Germany . | |
| 9201972 | 6/1993 | Germany . | |
| 55-135211 | 10/1980 | Japan | 92/79 |
| 2074271 | 10/1981 | United Kingdom | 92/79 |

*Primary Examiner*—Thomas E. Denion
*Attorney, Agent, or Firm*—Larson & Taylor

[57] ABSTRACT

In a work cylinder (1) a ring (10) has been respectively inserted in the cross-sectional plane of the line connection (for example 6), which has a conduit (13) corresponding with the connection. At the highest point in the work cylinder (1) this conduit (13) is connected with the pressure chamber (for example 4) via an inlet opening (14). This arrangement has the advantage that the entrained air is carried along with the flow in the course of the movement of the piston (3). The air reaches the outside through the reservoir.

3 Claims, 2 Drawing Sheets

HYDRAULIC POWER CYLINDER

BACKGROUND OF THE INVENTION

1. Field of the Invention

The invention relates to a hydraulic work cylinder with a piston, whose piston rod is connected with an adjusting device. The piston divides the work cylinder into pressure chambers which can be alternately charged. Line connectors for the feeding of the hydraulic oil lead into the pressure chambers.

2. Description of the Prior Art

These work cylinders are often used in connection with toothed rack power steering devices, wherein the piston rod and toothed rack are one piece which engages a pinion. Such a power steering device is known, for example, from EP 0 554 086 A2. A high degree of efficiency is expected of such a steering device, which operates with a control valve which is closed in the neutral position and whose steering circuit contains a pressure reservoir. The designer must take care that the areas of the system which are exposed to changing pressures have good ventilation. It is necessary to minimize the flexibility in the area between the entrance edge of the control valve and the work cylinder, since the pressure medium volume needed for filling the flexible area flows into the reservoir unused during the subsequent drop. A frequent cause of this flexibility is trapped air. It is therefore important that these hydraulic circuits are always operated with self-ventilation. It is possible to achieve self-ventilation of work cylinders by disposing the line connections at the top. During movement of the piston the enclosed air is then pushed out through the lines into the reservoir. However for reasons of safety and space it is often not possible to place the line connections at the top. They are therefore often found at the bottom or the sides of the work cylinder. A lateral arrangement of the line connections is shown for example in EP 0 518 922 B1 (FIGS. 1 and 2).

It is the object of the invention to create a device which makes continuous self-ventilation possible even with the line connections at the bottom of the work cylinder. This requirement should be realized without an increase in the size of the steering system and with little additional outlay.

This object is attained by the present inventions. Advantageous further developments are described in the specification.

SUMMARY OF THE INVENTION

In accordance with the main embodiments of the invention, a ring with a conduit which corresponds with the connections is located in the cross-sectional plane of the line connections in the work cylinder. This conduit is connected with the pressure chamber via inlet openings with the inlet opening located at the highest point in the work cylinder. By means of the invention the air, which has collected at the highest point of the work cylinder, is transported along in the course of a movement of the piston and is transported by means of the speed of the flow via the conduit and the lines to the reservoir. Finally, the air can be vented through the reservoir cover, which contains vents.

In accordance with a preferred embodiment, the conduit of the ring is U-shaped and is open along the exterior diameter, whereby the conduit extends over the entire circumference of the ring.

In accordance with another preferred embodiment, the ring which is open along the exterior only extends over only a portion of the circumference. The annular conduit can be easily cut and at high flow speeds its short length causes a very rapid removal of the pressure medium with the entrained air. In accordance with a variant of the invention, the ring can also be connected with a reinforcing ring of an axial seal. In that case the ring is advantageously formed in one piece on the reinforcing ring. This embodiment has the advantage of the common installation of the axial seal with the ring and easier warehousing.

Finally, in accordance with an alternate embodiment it is also possible to suspend the ring from the reinforcing ring of the axial seal by means of a snap connection.

The invention will be explained in detail by means of two exemplary embodiments represented in the drawings.

BRIEF DESCRIPTION OF THE DRAWINGS

FIGS. 1 and 2 show a work cylinder 1 with a continuous piston rod 2, which supports a piston 3. The piston 3 is shown in its leftmost position. The piston 3 divides the work cylinder 1 into pressure chambers 4 and 5. The arrangement in accordance with the invention can be employed with both line connections, however, for the sake of simplicity only one line connection 6 for supplying or removing the pressure medium is shown. An axial seal 7 has been inserted on the one side of the line connection 6. In addition, the piston 3 contains a seal 8. Since the seal 8 of the piston 3 is not permitted to move below a bore 6A of the line connection 6, a space around the bore 6A is not usable for the stroke of the piston 3. In accordance with the invention, a ring 10 has been inserted into this space which is located in a cross-sectional plane of the line connection. This ring 10 can be fixed in a notch 12 in an indentation 11 of the work cylinder 1. The ring 10 has a U-shaped conduit 13 which can extend over part of or the entire circumference. It is essential that an inlet opening 14 is provided in the pressure chamber 4 at the highest point of the ring 10. This inlet opening 14 is connected via the conduit 13 with the line connection 6. By means of the arrangement in accordance with the invention removal of pressure medium always takes place at the highest point of the work cylinder 1. The flow speed in the comparatively narrow cross section of the conduit is so high that the air is forced downwardly along with the flow.

FIG. 3 shows a further embodiment with an axial seal 15 for a piston rod 16. This axial seal 15 has a reinforcing ring 17 on which a ring 20, which is connected with the line connection 18, is formed. This ring 20 also has an inlet opening 21.

As shown in FIG. 3A, it is also possible to suspend a ring 22 in a reinforcing ring 24 of an axial seal 25 by means of a snap connection.

Figure 1:
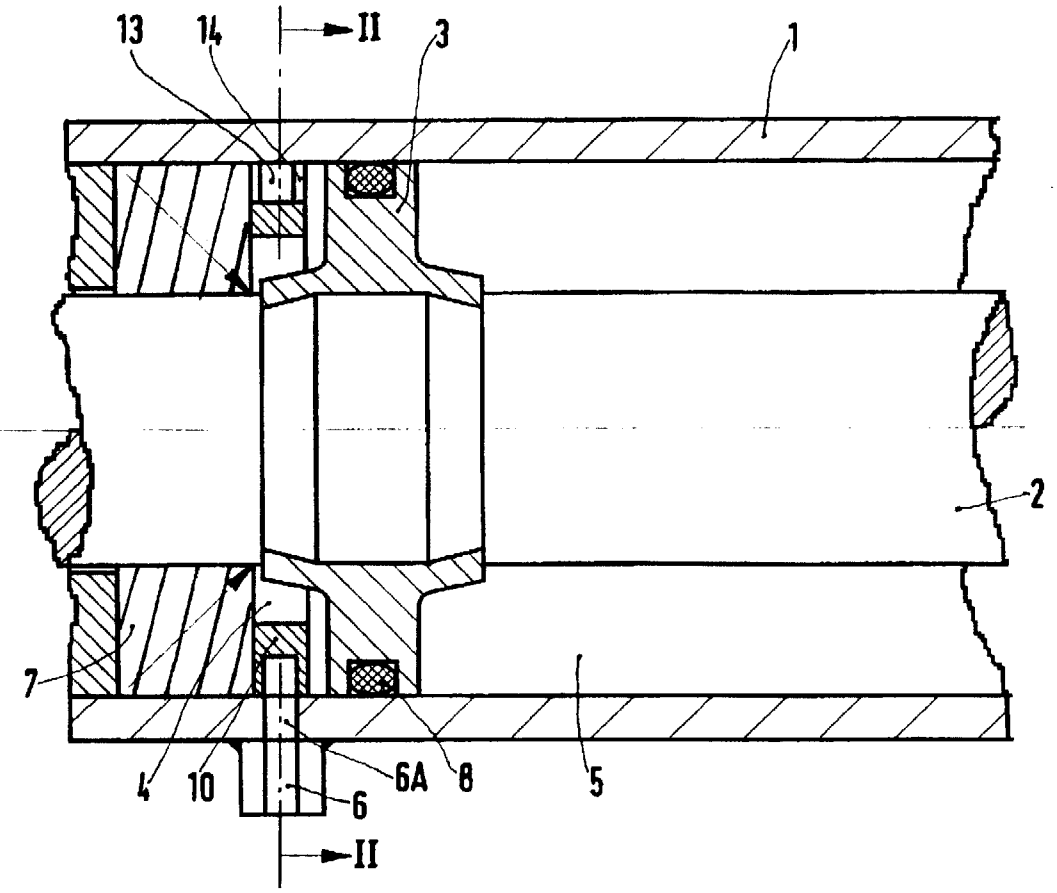
FIG. 1, a partial longitudinal section through a work cylinder.
Figure 2:
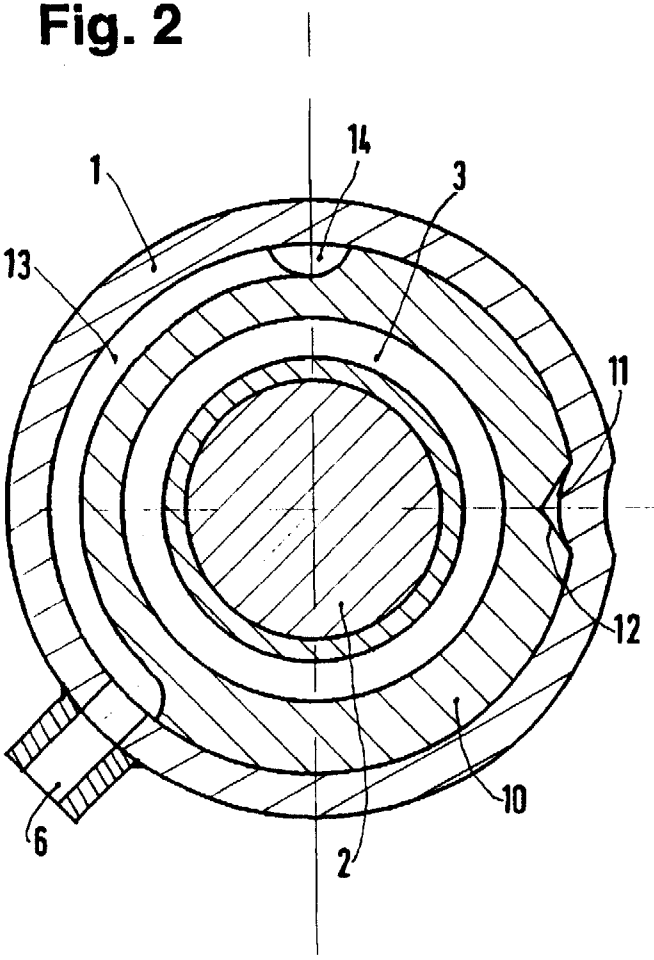
FIG. 2, a cross section along the line II—II in FIG. 1.
Figure 3:
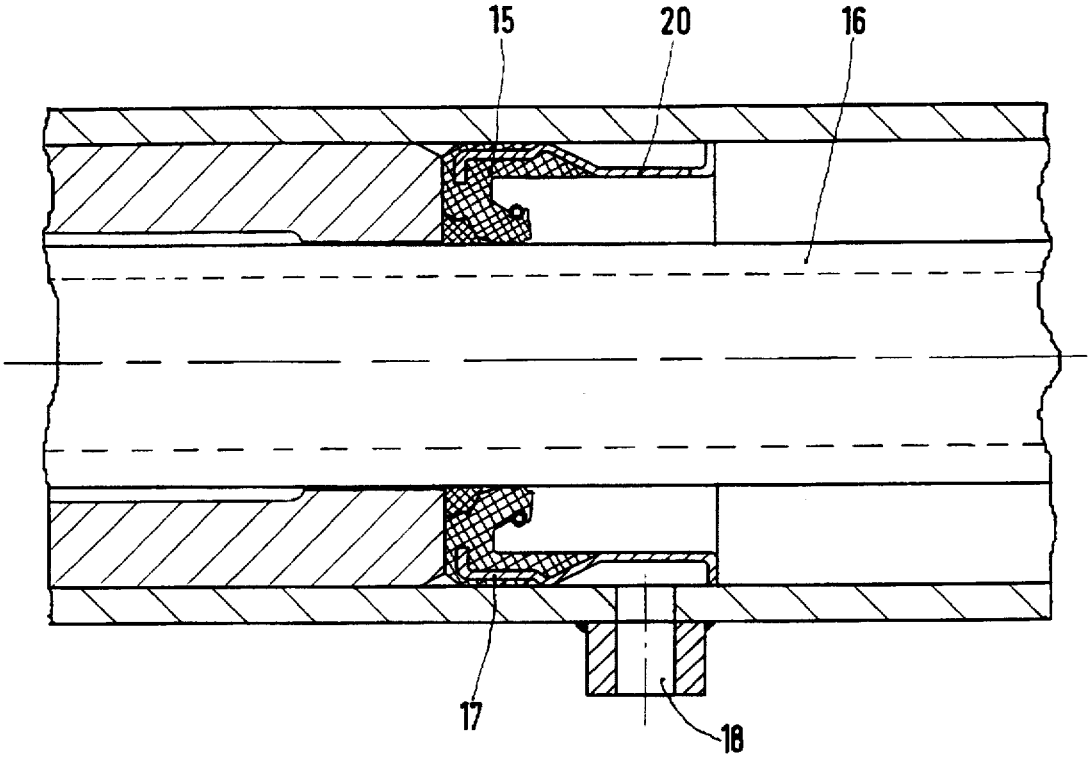
FIG. 3 and FIG. 3A are further partial longitudinal sections showing other embodiments.
Figure 3A:
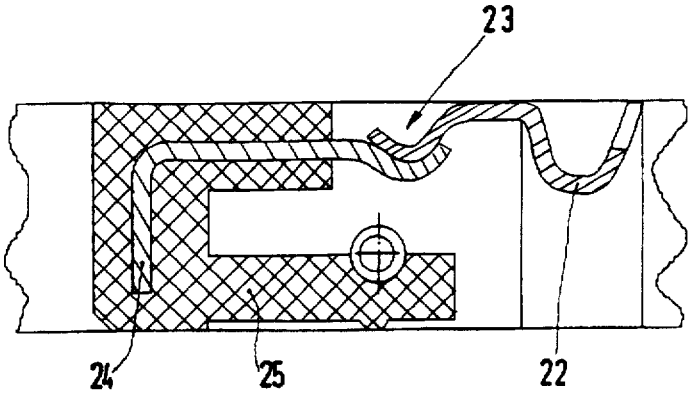

We claim:

1. A hydraulic work cylinder which comprises:

a work cylinder, a piston having a piston rod which is connected with an adjustment device, said piston being movably disposed in the work cylinder to divide the work cylinder into two pressure chambers which can be alternately charged;

at least two line connections each of which is connected to at least one pressure chamber for supplying or removing hydraulic fluid to or from the pressure chambers;

two rings connected with a reinforcing ring of an axial seal, each of said two rings located in a cross-sectional plane of the line connection in the work cylinder between the pressure chamber and corresponding line connection and including a conduit therein which is fluidly connected to the line connection; and wherein each conduit is connected with the respective pressure chamber via an inlet opening located at a highest point of the work cylinder.

2. The hydraulic work cylinder in accordance with claim 1, wherein each ring is suspended from the reinforcing ring by means of a snap connection.

3. The hydraulic work cylinder in accordance with claim 1, wherein each ring is formed as one piece with the reinforcing ring.

* * * * *